US006996925B2

(12) United States Patent
Harding

(10) Patent No.: US 6,996,925 B2
(45) Date of Patent: Feb. 14, 2006

(54) COMBINATION PLOW AND CLAW ASSEMBLY

(76) Inventor: Woodward D. Harding, 65 Spring Garden St., Hamden, CT (US) 06517

( * ) Notice: Subject to any disclaimer, the term of this patent is extended or adjusted under 35 U.S.C. 154(b) by 0 days.

(21) Appl. No.: 10/765,616

(22) Filed: Jan. 27, 2004

(65) Prior Publication Data

US 2004/0187362 A1 Sep. 30, 2004

Related U.S. Application Data

(63) Continuation-in-part of application No. 10/404,762, filed on Mar. 31, 2003, now Pat. No. 6,892,482.

(51) Int. Cl.
*E02F 3/96* (2006.01)

(52) U.S. Cl. ..... 37/405; 37/408; 37/409; 37/410

(58) Field of Classification Search ..... 37/405, 37/403, 404, 408, 409, 410, 411, 446; 172/817
See application file for complete search history.

(56) References Cited

U.S. PATENT DOCUMENTS

| | | | | |
|---|---|---|---|---|
| 2,824,391 A | | 2/1958 | Reomer | |
| 3,209,474 A | | 10/1965 | Artman | |
| 3,595,416 A | * | 7/1971 | Perrotti | 414/704 |
| 3,975,844 A | * | 8/1976 | Olson | 37/405 |
| 4,077,529 A | | 3/1978 | Leyrat et al. | |
| 4,241,525 A | * | 12/1980 | Mann | 172/777 |
| 4,262,753 A | | 4/1981 | Vanchot | |
| 4,274,213 A | | 6/1981 | Yadlowsky | |
| 4,346,928 A | | 8/1982 | Towsend | |
| 4,364,191 A | | 12/1982 | Cazes | |
| 4,372,063 A | | 2/1983 | Work | |
| 4,407,080 A | * | 10/1983 | Mann | 37/405 |

(Continued)

FOREIGN PATENT DOCUMENTS

JP 1-163322 * 6/1989

*Primary Examiner*—Victor Batson
(74) *Attorney, Agent, or Firm*—DeLio & Peterson, LLC

(57) ABSTRACT

A combination plow and claw assembly is provided which is attached to a vehicle. The assembly is used for plowing a surface and/or for clawing a surface wherein the function of the combination plow and claw assembly can be easily changed by an operator of the vehicle during operation of the assembly so that a plowing function can be obtained when the vehicle is moved forward and a clawing function obtained when the vehicle is moved backward. In a preferred aspect, a rotating plate (which can be a flexible rake tine or a serrated plate) is fixedly connected to a rotating shaft. A drive shaft is axially disposed in the rotating shaft and secured to the rotating shaft. The drive shaft extends through openings in support plates and is fixedly connected to rotating means. The rotating plate in combination with a stationary plate converts the assembly into a plow or claw depending on the rotation of the rotating plate. In another aspect of the invention, a conventional plow is modified to provide a combination plow and claw assembly wherein an elongated support member is rotatably attached to the conventional plow and a claw plate is fixedly secured to the support member. When the assembly is used as a plow, the claw plate is rotated to an upward plow position and when the assembly is used as a claw, the claw plate is rotated in a downward position so that the unsecured end of the claw plate is proximate the surface being clawed.

7 Claims, 17 Drawing Sheets

U.S. PATENT DOCUMENTS 4,566,844 A 1/1986 Campin
4,890,400 A 1/1990 Long
4,907,357 A 3/1990 Lilienthal
4,928,410 A 5/1990 Walters et al.
5,140,763 A 8/1992 Nichols, IV
5,311,684 A 5/1994 Van Dalfsen
5,544,435 A * 8/1996 Somero ..... 37/405
5,664,348 A * 9/1997 Omann ..... 37/405
5,682,953 A 11/1997 Buysse
5,715,613 A 2/1998 Ebert
5,729,919 A 3/1998 DeBoer
5,782,019 A 7/1998 Launder et al.
5,797,461 A * 8/1998 Noble ..... 172/200
5,992,062 A 11/1999 Evans et al.
6,088,938 A 7/2000 Logan
6,154,985 A 12/2000 Champagne et al.
6,182,385 B1 2/2001 Knutson
6,370,801 B1 4/2002 Weyer et al.
6,470,604 B1 10/2002 Foster et al.

* cited by examiner

COMBINATION PLOW AND CLAW ASSEMBLY

This is a continuation-in-part of U.S. application Ser. No. 10/404,762, filed Mar. 31, 2003.

BACKGROUND OF THE INVENTION

1. Field of the Invention

The present invention relates to plows which are attached to the front end of a vehicle for plowing earth, snow and other such materials and, in particular, to a combination plow and claw assembly which can easily be changed by the operator of the vehicle during use of the assembly to function as a plow when the vehicle is moved in a forward direction or as a backward plow, scraper, rake or other such device when the vehicle is operated in a backward direction.

2. Description of Related Art

Plows are well known in the art for removing snow or moving earth to level or grade the ground and most conventional plows utilize a steel plow or blade mounted on the front of a pick-up truck, bulldozer, tractor, ATV, earthmoving equipment, tracked vehicles or similar vehicle. Such blades (also called moldboards) are typically curved with a concave front surface so that when the vehicle travels in a forward direction, snow or earth is tossed in front and/or to the side of the blade to provide a clean or graded surface. These blades are typically mounted on hydraulic rams which are capable of raising and lowering the blades and maintaining the blade in a selected vertical position as well as angling the blade in a horizontal plane so that the earth, snow or other material may be deposited selectively toward the left side or toward the right side of the vehicle.

The foregoing type of plow has limited usefulness however, since the vehicle must be moved in a forward direction to move the snow, earth, or other material. When such a plow is moved in a backward direction the efficiency of the blade decreases. For convenience, the following description will be directed to the use of a plow for moving earth but it will be appreciated by those skilled in the art that the plow of the invention may be used for other material moving operations such as snow removal, in grain silos, spreading of gravel, in sewage tanks where the assembly may be mounted on a device other than a vehicle, the preparation of a surface before pouring concrete on the surface such as the spreading of plastic (Styrofoam) granules on the surface, and the like. The term "plow" will be used herein to mean a device which is attached to the front of a vehicle and the vehicle is moved forward to move the earth. The term "claw" will be used herein to mean a device which is attached to the front of a vehicle and the vehicle is moved backward to scrape or pull the earth and/or to rake or till the earth.

In earth moving operations it is often necessary to not only move the earth on a site in a forward direction to remove the earth or grade the ground, but also to smooth the ground to provide a level, smooth surface. Many earthmoving operations also require in addition the raking or tilling of the soil for seeding such as the planting of grass. As can be appreciated, a complete job of moving earth and then preparing the ground for a finishing operation such as seeding requires a number of different steps and operations and typically a number of different type equipment such as plows, backhoes, claws, rakes and the like are needed to perform each step. The need for multiple devices is costly and it is time consuming to change the device on the vehicle for each different operation.

Devices have been developed for use on both the front and the back of a vehicle to provide a clawing (e.g. scraping or leveling) function but, for back attached devices, the vehicle must still be operated in a forward direction which makes it difficult for the operator to see what is happening and to control the clawing function of the device. A plow may also be used in a forward direction to perform all the above functions, but this does not provide a satisfactory grading of the ground and the ground would still have to be further worked to smooth and level the ground and to rake the ground. It will also be appreciated that the vehicle using a conventional plow would require a large amount of maneuvering to properly position the plow for each of the different plowing operations.

Bearing in mind the problems and deficiencies of the prior art, it is therefore an object of the present invention to provide a combination plow and claw assembly which is attached to a vehicle for plowing a surface and for clawing a surface which assembly can easily be changed to the desired plow or claw function by the operator of the vehicle during operation of the vehicle and which does not interfere with the visibility of the operator.

It is another object of the present invention to provide a conventional plow which has been modified so that the plow assembly can function as both a plow for plowing and/or a claw for clawing a surface, which plow assembly can easily be changed to the desired function by the operator of the vehicle during operation of the vehicle.

It is yet another object of the present invention to provide a combination plow and claw assembly for plowing a surface and for clawing a surface wherein the claw has tines so that a raking function is effected and which combination plow and claw assembly can be easily changed to the desired function by the operator of the vehicle during operation of the vehicle. The claw may also have retractable and extendable tines to further enhance the effectiveness of the assembly.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a combination plow and claw assembly for plowing a surface and clawing a surface wherein the function of the assembly can be easily changed by the operator of the vehicle during use of the assembly comprising:

- a first elongated horizontal pipe support member;
- a support flange fixedly secured to each end of the elongated horizontal pipe support member, the pipe having a longitudinal opening extending along the length of the pipe between the support flanges;
- an angularly downward plow plate extending between the support flanges and fixedly secured to each support flange and/or the lower portion of the elongated horizontal pipe support member;
- a second rotatable elongated horizontal pipe support member axially disposed within the first elongated horizontal pipe support member and extending past at least one of the outer surfaces of the support flanges;
- a plow and claw plate fixedly secured to the second rotatable elongated horizontal pipe support member, the plate being preferably curved inward toward the plate at its unsecured end;

means for rotating the second rotatable elongated horizontal pipe support member; and support means for attachment of the first elongated horizontal pipe support member and/or the support flanges to moving means;

wherein, when the plow and claw assembly is used as a plow with the moving means moving forward, the second rotatable plow and claw plate is rotated to an upward position and, when the plow and claw assembly is used as a claw with the moving means moving backward, the second rotatable plow and claw plate is rotated to a downward position so that the unsecured end of the plate is proximate the surface being clawed.

In another aspect of the invention the second rotatable elongated horizontal pipe support member has a longitudinal opening extending along the length of the pipe between the support flanges and the second plow and claw plate is fixedly secured to the edges of the opening.

In another aspect of the invention a combination plow and claw assembly for plowing a surface and for clawing a surface wherein the operator of the vehicle can easily change the function of the assembly during use of the assembly is provided comprising:

a conventional plow including a plow having a plow surface, support means for attaching the plow to a vehicle and adjusting means for adjusting the position of the plow and plow surface;

an elongated horizontal support member rotatably attached to the plow and running along the plow surface;

a claw plate fixedly secured to the elongated horizontal support member; and means for rotating the elongated horizontal support member;

wherein, when the assembly is used as a plow when the vehicle is moved forward, the claw plate is rotated to an upward position and, when the assembly is used as a claw and the vehicle is moved backwards, the claw plate is rotated to a downward position so that the unsecured end of the plate is proximate the surface to be clawed.

In a further aspect of the invention the claw plate is curved inward toward the plate at its unsecured end.

In another aspect of the invention the claw plate comprises a plurality of tines or the end of the claw plate contains a plurality of tines which tines provide a raking function to the surface being clawed.

In an additional aspect of the invention the claw plate has gussets holding movable tines which can be extended or retracted from the unsecured end of the plate depending on the operation being performed so that the tines will be extended if a raking function is desired and retracted if a scraping function or leveling function is desired.

In another aspect of the invention a combination plow and claw assembly is provided for plowing a surface and clawing a surface wherein the function of the assembly can be easily changed by the operator of a vehicle during use of the assembly comprising:

opposed fixed support plates connected by an elongated cross member forming a support structure;

an elongated rotating member rotatably mounted in openings in the support plates;

means to rotate the rotating member;

an elongated rotating plate fixedly connected to the rotating member and having a lower end and an upper end;

an elongated stationary plate fixedly connected to the support plates and having an upper end and a lower end; and support means for attachment of the structure to vehicle moving means;

wherein, when the plow and claw assembly is used as a plow with the vehicle moving means moving forward, the elongated rotating plate is rotated to an upward position so that the lower end of the rotating plate and upper end of the stationary plate are proximate and, when the plow and claw assembly is used as a claw with the vehicle moving means moving backwards, the elongated rotating plate is moved to a downward position so that the upper end of the rotating plate is below the lower end of the stationary plate and proximate the surface to be clawed.

In a preferred aspect, the rotating plate and rotating shaft are fixedly connected together and is sized to fit between the support plates. An inner rotating drive shaft extends from the rotating means through openings in the support plates and is axially disposed in the rotating shaft. The drive shaft is fixedly connected to the rotating shaft so that when the drive shaft is rotated, the rotating shaft and rotating plate are likewise rotated to the desired position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
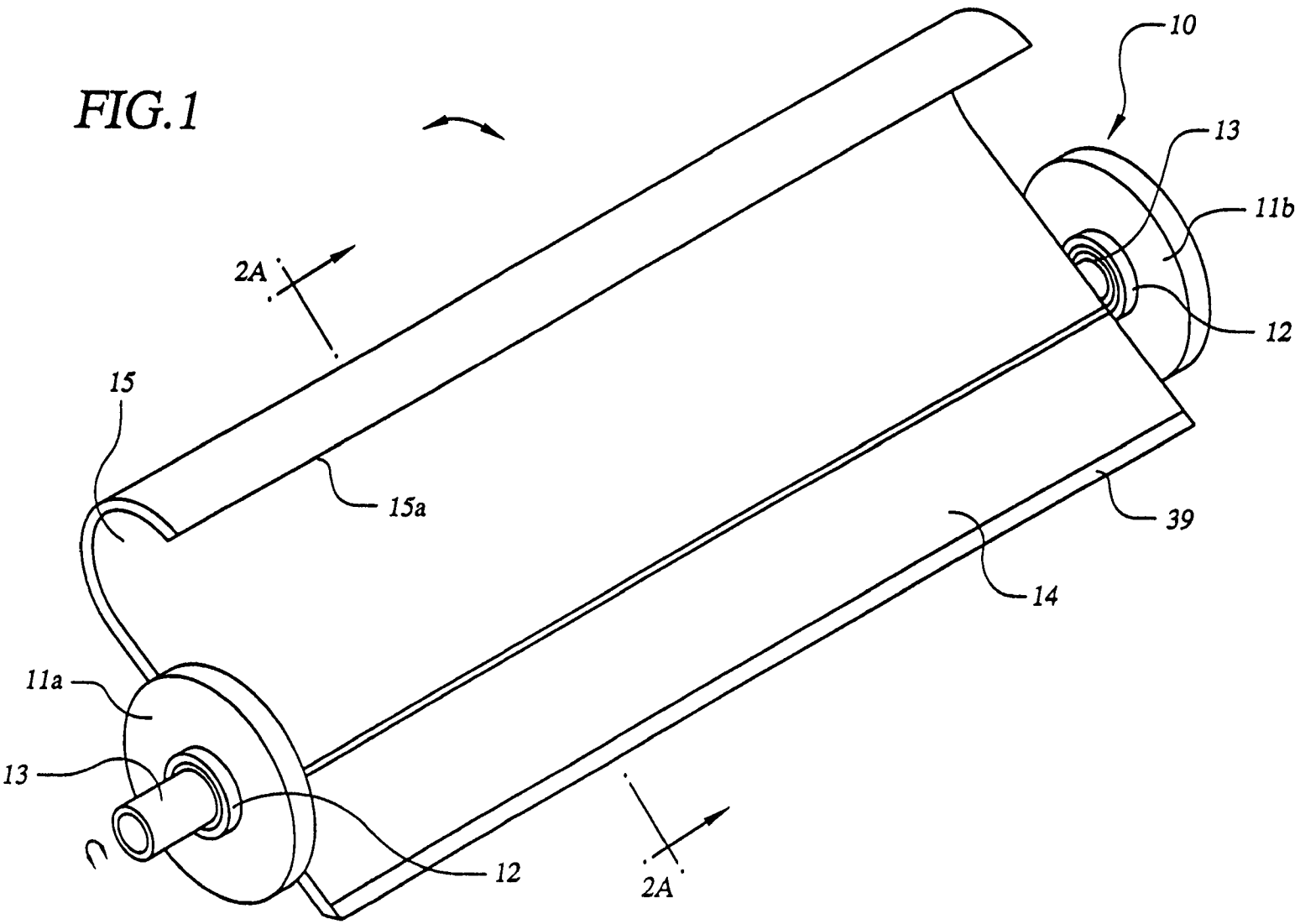
FIG. 1 is a perspective view of a combination plow and claw assembly of the invention.

In describing the preferred embodiment of the present invention, reference will be made herein to FIGS. 1–16B of the drawings in which like numerals refer to like features of the invention. Features of the invention are not necessarily shown to scale in the drawings.

Referring now to FIG. 1 the combination plow and claw assembly of one aspect of the invention is shown in perspective view as numeral 10. The assembly comprises a left plate 11*a* and a right plate 11*b* which are fixedly secured to an outer pipe 12 which extends through openings in the plates. An inner pipe 13 is axially disposed in outer pipe 12 and is shown extended past outer pipe 12 and left flange 11*a*. A conventional bearing would be used between outer pipe 12 and inner pipe 13 so that inner pipe 13 can rotate as shown by the arrows. As will be more fully described hereinbelow, any suitable moving mechanism such as a hydraulic cylinder, gear, or the like will be used to rotate inner pipe 13 to position the combination plow and claw assembly in either the plow function or the claw position.

Fixedly secured to outer pipe 12 is a lower plow plate 14 which is angularly disposed. A trip plate 39 is shown at the lower edge of bottom plow plate 14. The trip edge may be any of a conventional device as known in the art to absorb any forces encountered by obstructions in the road or surface being plowed when hit by the plow plate 14. Fixedly secured to the inner pipe 13 is a rotatable plow plate 15 which is shown having an inwardly curved end 15*a*. As will be more fully described hereinbelow, in operation, the configuration shown in FIG. 1 will be used as a plow when it is desired to plow snow, earth and the like. When it is desired to perform a claw function such as scraping or leveling earth, the rotatable plow plate 15 is rotated downward as shown by the arrow so that the edge 15*a* of plow plate 15 is proximate the surface to be clawed. A trip plate may also be used on the rotatable plow plate 15 at edge 15*a* to absorb forces encountered by obstructions when the assembly is used in the claw position.

Figure 2A:
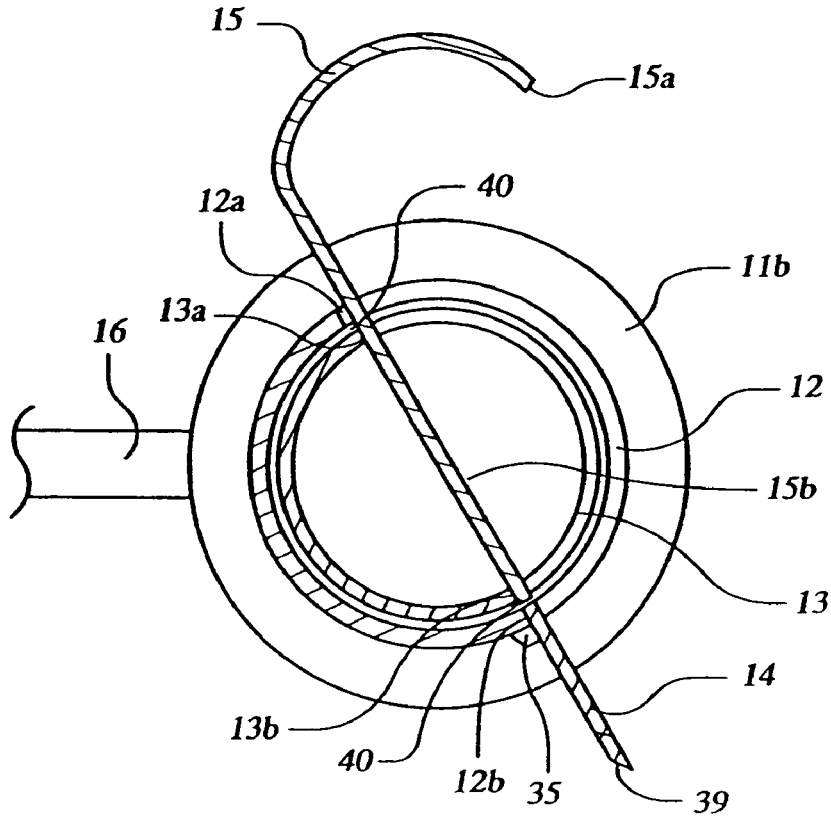
FIG. 2A is a sectional view of FIG. 1 taken along lines 2A—2A.

FIG. 2A is a sectional view of FIG. 1 and shows in detail how the rotatable plow plate 15 is secured to the inner pipe 13. Firstly, outer pipe 12 has a longitudinal opening running along the length of the pipe to accommodate the movable plow plate 15. The outer pipe 12 has been cut at points 12*a* and 12*b* to form the longitudinal opening running along the length of the pipe. Likewise, inner pipe 13 is also shown to have a longitudinal opening formed by edges 13*a* and 13*b*. The rotatable plow plate 15 is fixedly secured to the inner pipe 13 at points 13*a* and 13*b* by weld 40 or other such securing means. Lower plow plate 14 is shown fixedly secured to outer pipe 12 at point 12*b* by weld 35. The bottom plow plate 14 has a trip plate 39 at the lower end thereof. A support 16 is shown fixedly secured to outer pipe 12 which would be secured to the vehicle using conventional means. Support 16 can also be fixedly secured to flanges 11*a* and 11*b* to further strengthen the support. The support will be used with a conventional plow support wherein the plow can be raised or lowered and maintained in a desired position and also angling the blade in a horizontal plane.

A feature of the invention as shown in FIG. 2A is the smooth plow surface formed by rotatable plow plate 15 and plow plate 14.

Figure 2B:
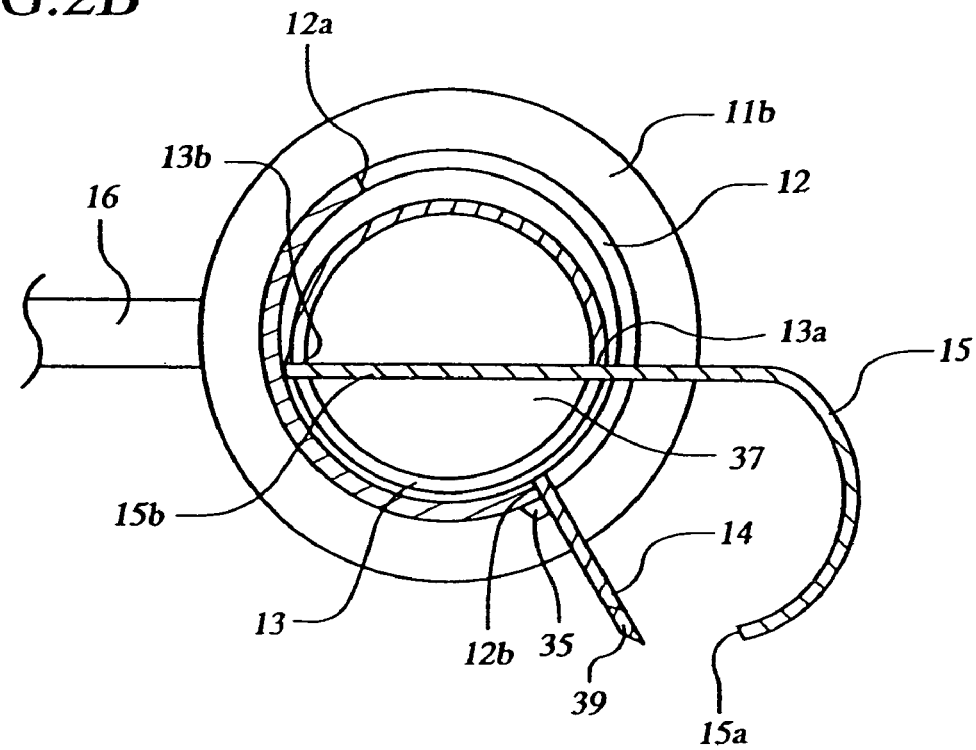
FIG. 2B is the sectional view of FIG. 2A with the rotatable plow plate of the assembly rotated to a clawing position.

FIG. 2B shows the plow and claw assembly of FIG. 2A wherein the rotatable plow plate 15 has been rotated downward so that the edge 15*a* of plow plate 15 is proximate the surface to be clawed. In this configuration the vehicle to which the assembly is attached would be moved backward as shown by the arrow so that the edge 15*a* would contact the surface to be clawed. FIG. 2A shows the combination plow and claw assembly in the plow function so that the vehicle would be moved forward as shown by the arrow so that the earth or snow would be plowed. Plow plate 15 can be rotated further downward below the plane of the plow plate (or upward above the plane of the plow plate) so that edge 15*a* is proximate the surface to be clawed.

Figure 3A:
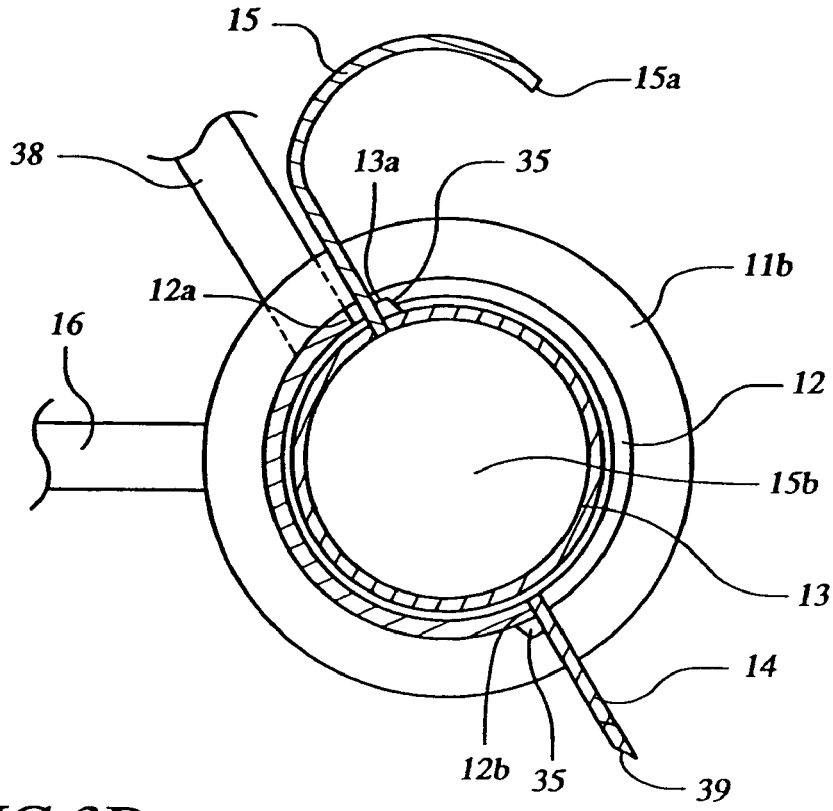
FIG. 3A is a sectional view of an embodiment similar to that shown in FIGS. 2A and 2B except that the rotatable plow plate is connected only to the outer wall of the inner pipe.

FIG. 3A shows another embodiment of the invention wherein the plow plate 15 is secured to inner pipe 13 at the surface of inner pipe 13 at point 13*a*. In this embodiment inner pipe 13 does not have a longitudinal opening running along the length of the pipe and the complete inner pipe is shown by the cross section. It will be noted that the outer pipe 12 still has the longitudinal opening with edges 12*a* and 12*b* to accommodate and allow rotation of inner pipe 13 and the rotatable plow plate 15. The movable plow plate 15 is shown secured to inner pipe 13 at point 13*a* by weld 35. Also shown is an additional support 38 which is fixedly secured to the outer pipe 12 and/or the left and right flanges 11*a* and 11*b*. It can be seen that support 38 provides additional support for the rotatable plow plate 15 in the plowing function since the outer surface of plow plate 15 rests against support 38 when in the plowing mode. When in the plowing mode the vehicle would be moved forward as shown by the arrow to plow earth or snow or any such material.

Figure 3B:
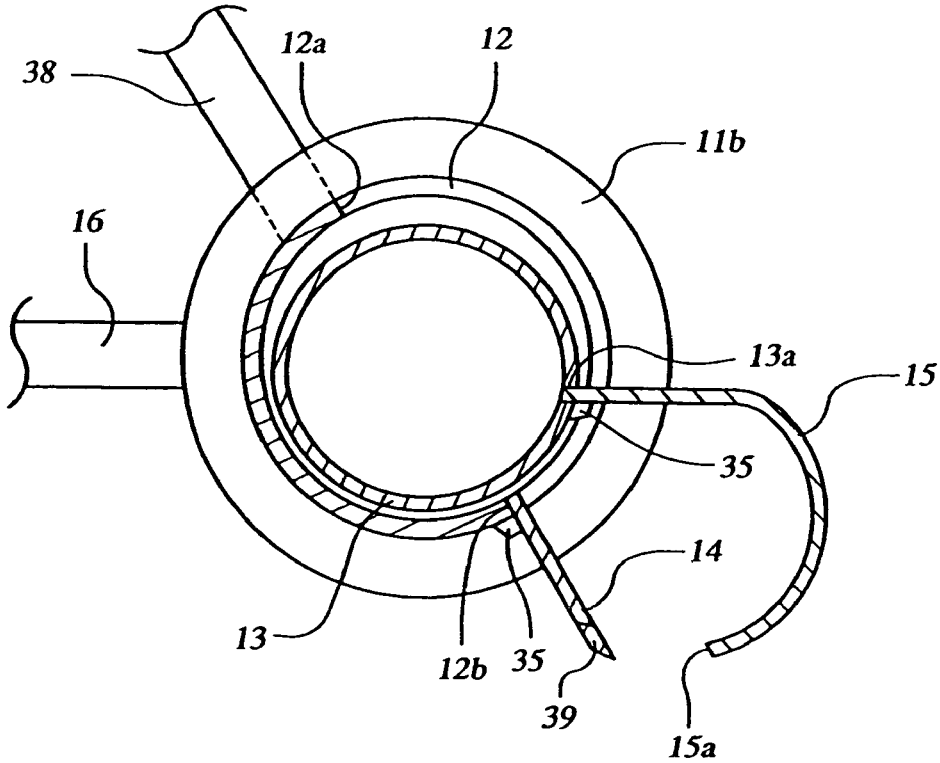
FIG. 3B is the same as FIG. 3A except that the rotatable plow plate has been rotated to a scraping position.

FIG. 3B shows the plow and claw assembly of FIG. 3A wherein the rotatable plow plate 15 is rotated so that the end 15*a* of the plow plate 15 is proximate the surface to be clawed. It will be appreciated in this embodiment that because rotatable plow plate 15 is fixedly secured to the surface of inner pipe 13 (which pipe does not have a longitudinal opening) that there is no opening in which the dirt or snow may be forced into during use of the assembly. This configuration is desirable for certain designs. The plow surface will not be smooth however as shown in FIG. 2A.

It will also be appreciated by those skilled in the art that the length and curvature of rotatable plow plate 15 can vary widely depending on the desired use of the assembly. Thus, a wider (higher) rotatable plow plate 15 would provide a larger plowing surface and, in the claw mode, the end 15*a* of the rotatable plow 15 would be further from the assembly providing additional clearance between the earth being clawed and the end of plow plate 14. Also, in any of the embodiments, the rotatable plow plate 15 can be rotated so that the end 15*a* thereof is above, on the same horizontal plane as lower plow plate 14 or extends below trip edge 39 of the plow plate 14. Thus, the plow and claw assembly can be modified to accommodate a wide variety of plowing and clawing conditions.

As shown hereinbelow for the modified conventional plow embodiment, the rotatable plow plate 15 can also be in the form of tines, have extendable and retractable tines at it's unsecured end or have a serrated edge to perform different scraping functions such as raking, tilling, etc.

Figure 4:
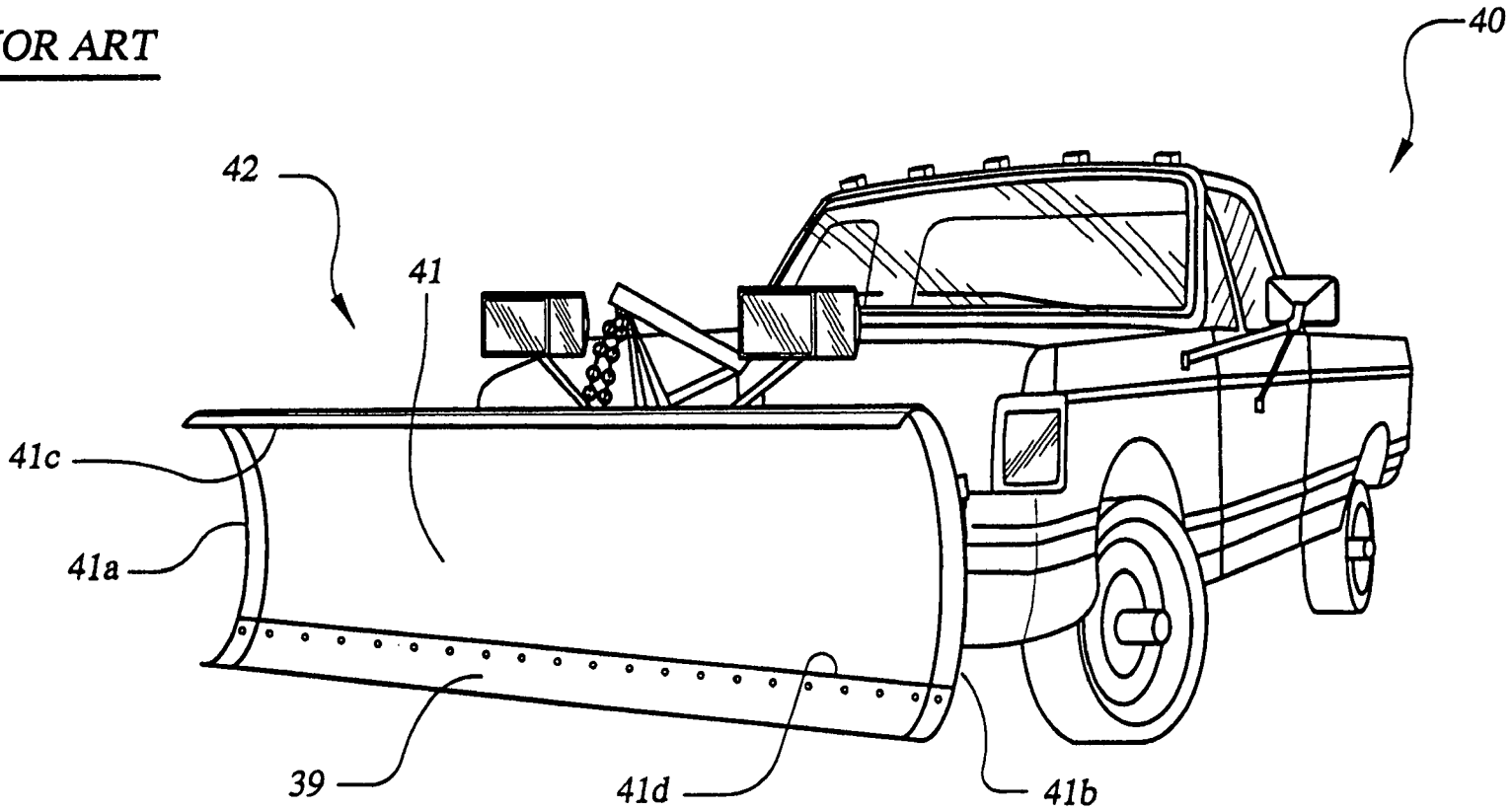
FIG.4 PRIOR ART
FIG. 4 is a perspective view of a conventional plow attached to a vehicle.

Referring to FIG. 4, a conventional plow 42 is shown attached to a vehicle 40. The plow 42 has a curved blade 41 and is shown secured to the vehicle by support 27. Support 27 is conventional and would contain means to raise and/or lower the plow blade and to angle the blade. Plow blade 41 has edges 41*a* and 41*b*, a top edge 41*c* and bottom edge 41*d* with a trip plate 39.

Figure 5A:
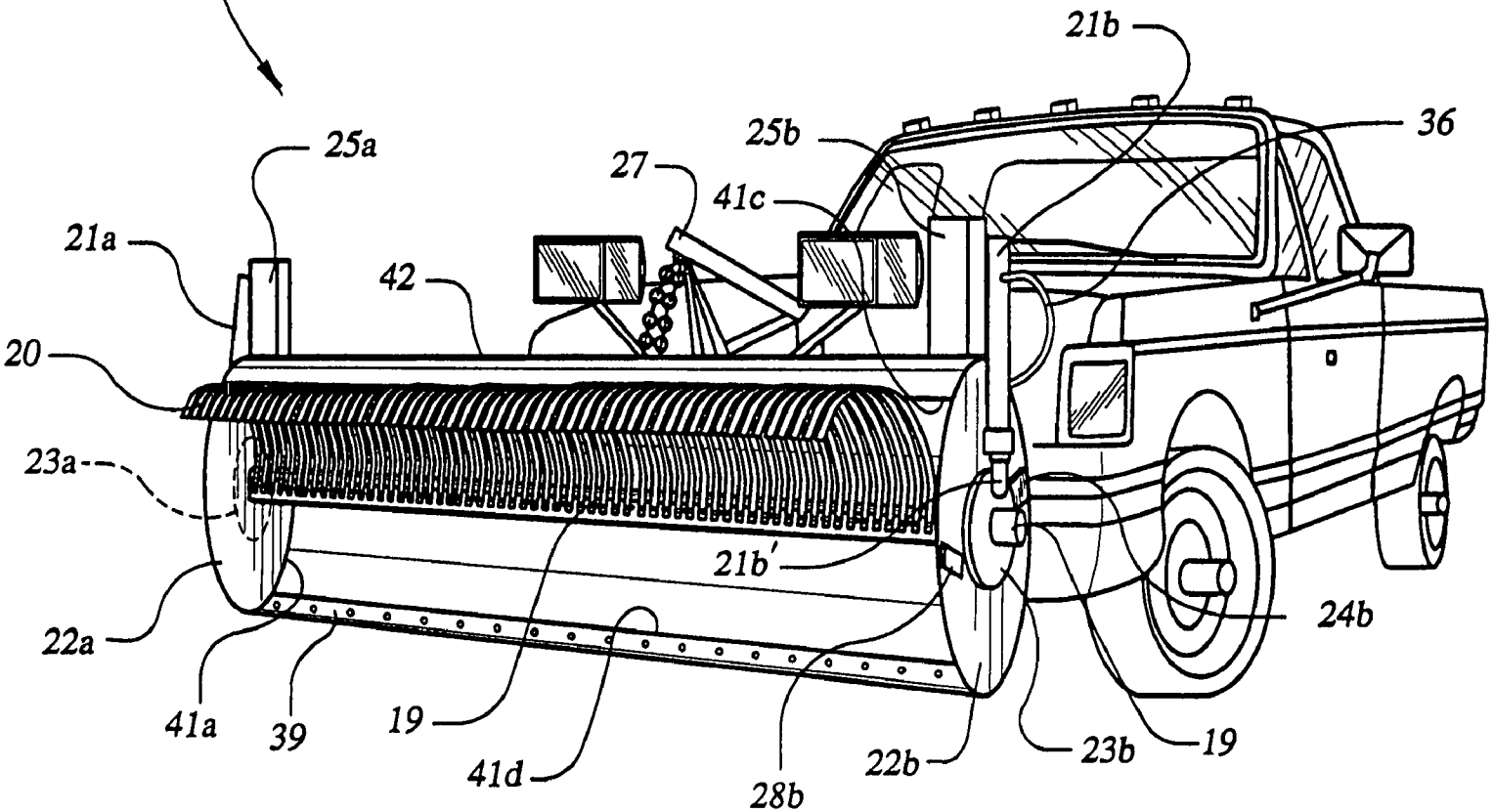
FIG. 5A is a perspective view of a plow and claw assembly of the invention made by modifying a conventional plow as in FIG. 4 and shown in the plowing position.

Referring now to FIG. 5A, a perspective view of another combination plow and claw assembly of the invention is shown. The assembly 17 is shown with a claw plate 20 having a plurality of tines but it will be appreciated by those skilled in the art that a solid plate may be used as shown above for a scraping action rather than a raking action.

In this embodiment, the conventional plow 42 of FIG. 4 has been modified to provide a claw function so that the modified plow assembly would provide both a plow function and a claw function. The embodiment is shown generally as 17 and comprises a conventional plow 42 which has been modified by providing a pipe 19 which extends horizontally along the length of the plow surface and through end plates 22*a* and 22*b* which are secured at the ends 41*a* and 41*b* of the plow blade 41 by welds or other securing means. The pipe 19 is shown extending through the right plate 22*b* and is fixedly secured to rotating flange 23*b*. A bearing would be used between the end plate and the pipe to allow rotation of the pipe. Rotating flange 23*a* has a radial projection 24*b*. A stop 28*b* is provided on the plate 22*b* which will stop rotation of the rotating flange 23*b* by contact with projection 24*b*. A piston 21*b* is shown pivotably secured at both its upper end to piston support 25*b* and at its lower end to rotating flange 23*b*. Pipe 19 has fixedly secured thereto a plurality of inward curved tines 20 running along the length of the pipe. A hydraulic line 36 is connected to piston 21*b* to move the piston rod 21*b* which rotates rotating flange 23*b*.

Figure 5B:
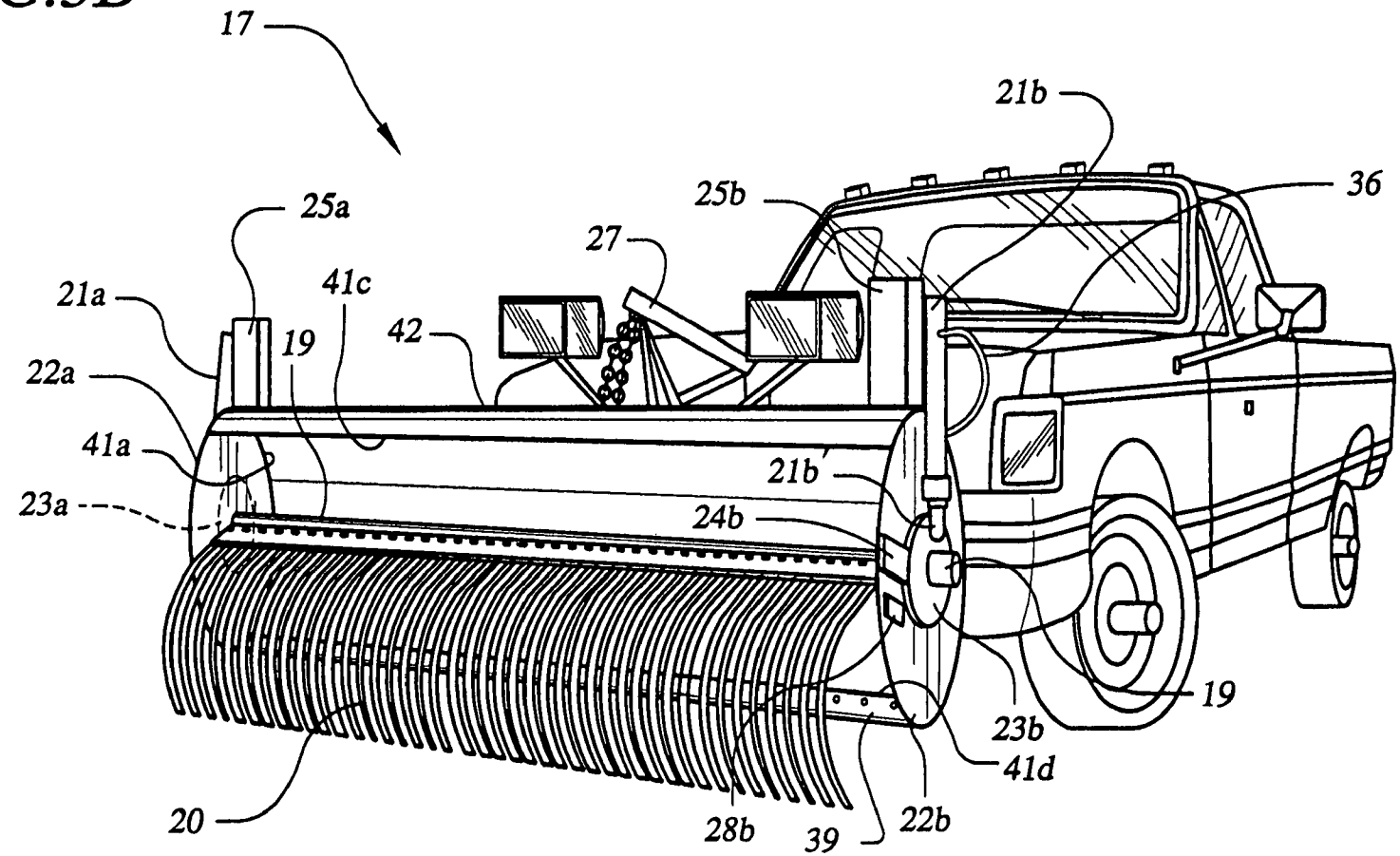
FIG. 5B is a perspective view of FIG. 5A showing the combination plow and claw assembly in the claw position.

FIG. 5B shows the tines 20 of FIG. 5A in the lowered position ready for a raking function. FIG. 5A shows the tines 20 in an upward plow position. If the operator desires to use the assembly 17 as a plow, the pistons 21*a* and 21*b* are activated to rotate the rotating flanges 23*a* and 23*b* and pipe 19 to position the tines 20 in the upward position as shown in FIG. 5A. If a raking function is desired, the operator activates pistons 21*a* and 21*b* to rotate rotating flanges 23*a* and 23*b* turning pipe 19 so that the tines 20 are rotated downward and the ends of the tines are proximate the surface to be raked. Only one piston need be used or any other means to rotate the rotating flanges such as a motor, etc.

Referring to FIG. 5A, piston rod 21*b*' is shown extended so that projection 24*b* of rotating flange 23*b* is facing the vehicle. This is the plow position. In FIG. 5B, piston rod 21*b*' is retracted and projection 24*b* is now proximate the stop 28*b*. Rotating flange 23*b* was therefore rotated so that the ends of the tines 20 are now in the clawing position.

Figure 6A:
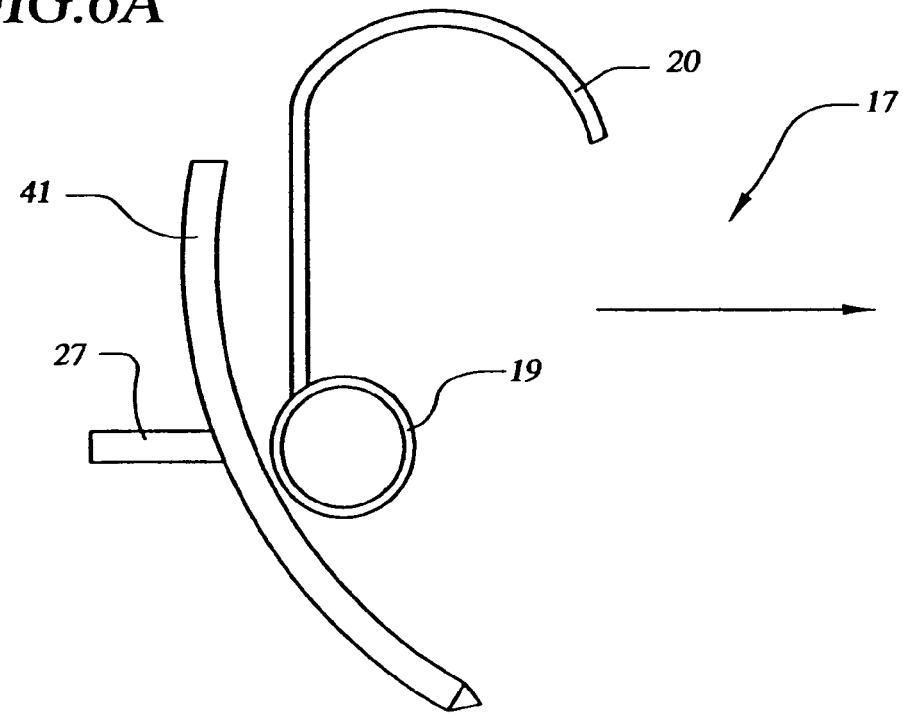
FIG. 6A is a sectional schematic view of the plow and claw assembly shown in FIG. 5A in the plow position.
Figure 6B:
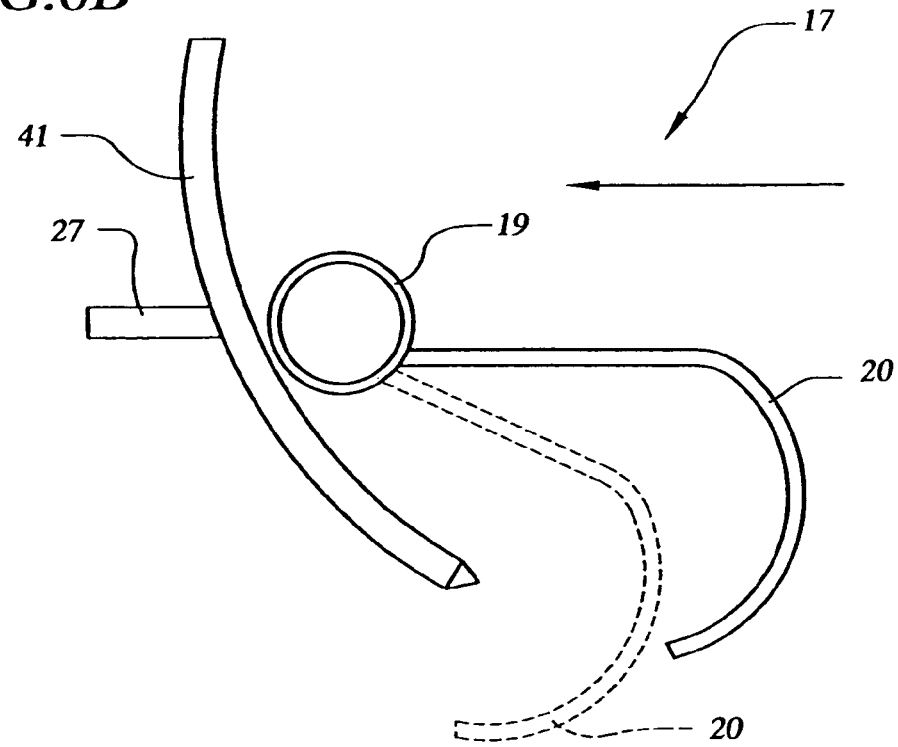
FIG. 6B is the plow and claw assembly shown in FIG. 5B in the claw position.

FIGS. 6A and 6B show a side schematic view of the plow and claw assembly 17 and how it functions in the plow position and rake position. Thus, in FIG. 6A, the plow and claw assembly 17 is shown in the plow position wherein the tines 20 are in the raised position. The vehicle would be moved in the direction of the arrow to plow the earth, snow or other such material. FIG. 6B shows that the pipe 19 has been rotated clockwise downward so that the tines 20 are now in the lowered position proximate the surface to be raked. The vehicle would be moved backward in the direction of the arrow to provide a raking function. Shown in phantom are tines 20 in a still further lowered position which may be used in certain situations depending on the ground to be raked. As will be appreciated, the pipe 19 can be rotated at any angle to position the ends of the tines above, at, or below the level of the lower end of the plow plate 41. Support 27 would be used to connect the plow and claw assembly to the vehicle.

Figure 7:
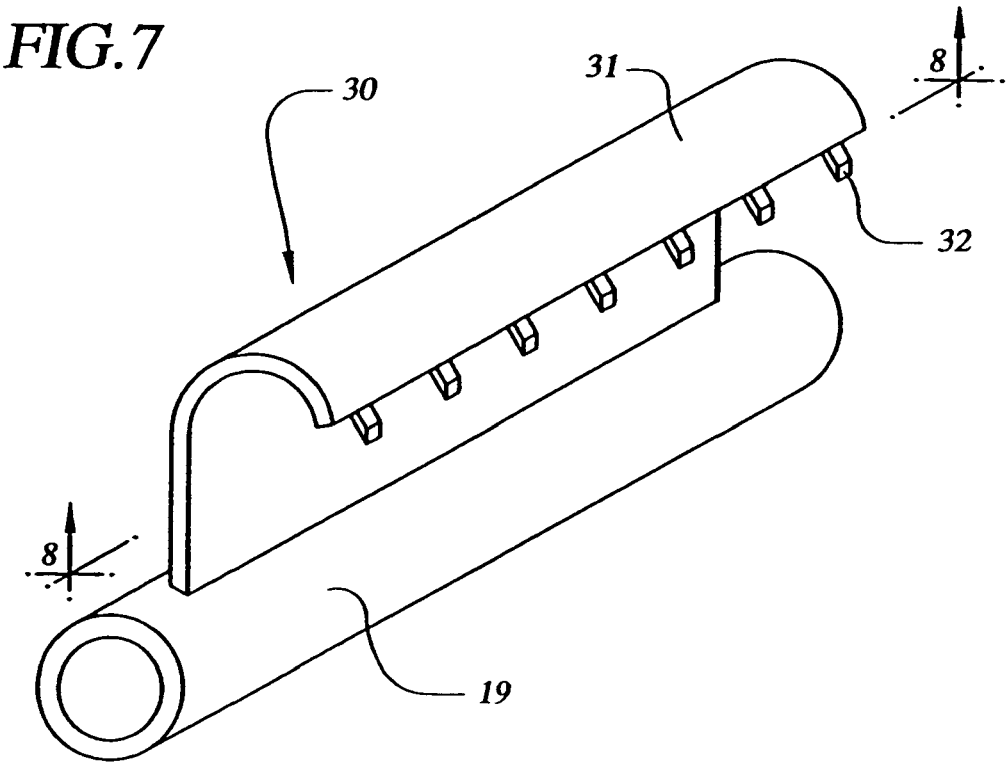
FIG. 7 is a perspective view of a rotatable pipe used in the plow and claw assembly of the invention wherein the claw plate is modified to have extendable and retractable tines.

Another embodiment of the plow and claw assembly 30 is shown in FIG. 7 wherein pipe 19 has a solid plate 31 attached to the pipe 19 by a weld or other means. The plate 31 has a plurality of tines 32 extending outward from the unsecured end. The tines 32 may be retracted or extended as shown in FIGS. 8 and 9 depending on the function desired by the operator.

Figure 8:
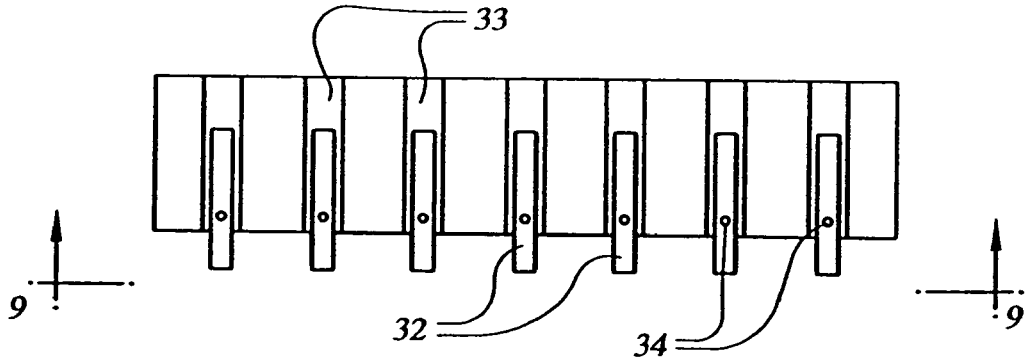
FIG. 8 is a section of FIG. 7 taken along lines 8—8.
Figure 9:
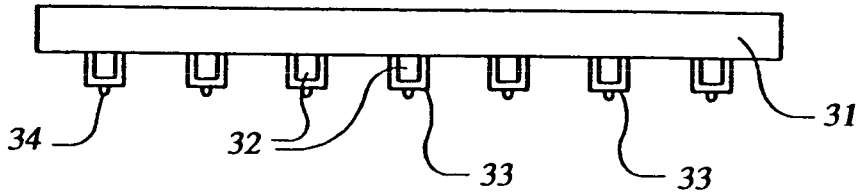
FIG. 9 is a sectional view of FIG. 8 taken along lines 9—9.

Thus, as shown in FIGS. 7, 8 and 9, tines 32 have been extended from the unsecured edge of plate 31 so that a raking function would be performed. Tines 32 extend from gussets 33 and would be secured in the extended position by fasteners 34 such as bolts or set screws. If it is desired to use the plate 31 as a scraper plate instead of a rake, the tines 32 would be retracted into plate 31 and secured in that position again by fasteners 34 such as bolts or set screws.

As will be appreciated by those skilled in the art, the rotating plate 31 can also have a serrated edge or other configuration for special uses. This requires however that the pipe 19 be adaptable to accommodate a variety of plates attached thereto for different functions. This can be accomplished by providing pipe 19 with attachment flanges for securing a plate thereto by the use of fasteners such as bolts which may easily be removed and rebolted. Thus, the plate attached to rotating pipe 19 can be a rake, a solid blade for scraping, have a serrated edge, etc. The embodiment shown in FIGS. 7, 8 and 9 is versatile in that a raking or scraping action can be performed using the same plate which utilizes extendable or retractable tines. In any event, the crux of the invention is to modify a conventional plow with a pipe or other support means extending along the horizontal length of the plow, which pipe is rotatable and which has fixedly secured thereto a plate, tines or other device which in the upright position the plow can still be used as a plow when the vehicle is moved in the forward position or the pipe can be rotated downward to provide a clawing action when the vehicle is moved backward.

Figure 10:
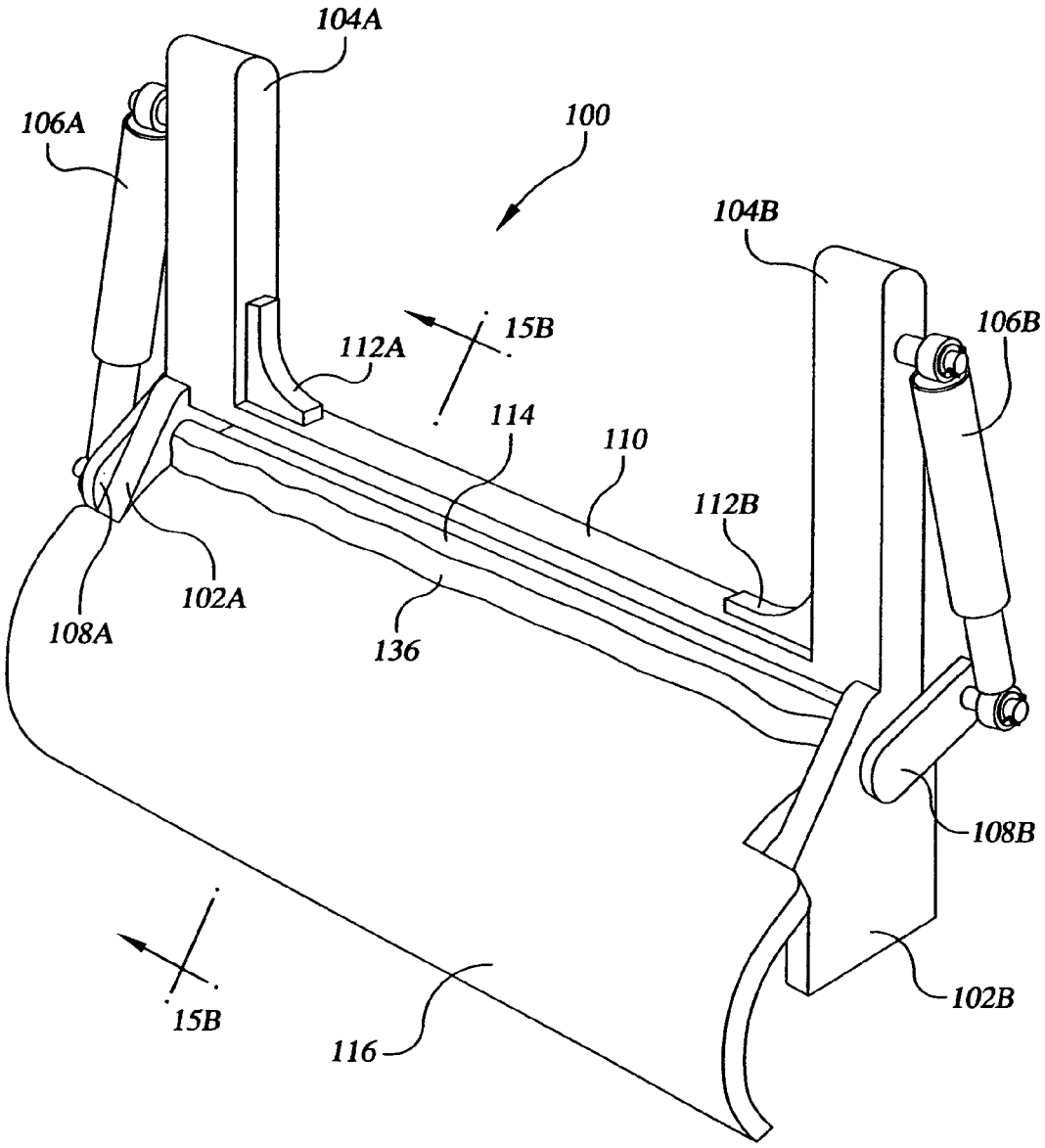
FIG. 10 is a perspective view of another combination plow and claw assembly of the invention in the claw position.

Referring now to FIG. 10, another claw and plow assembly of the invention is shown generally as numeral 100. The assembly comprises opposed fixed support plates 102A and 102B connected by cross member 110 and preferably having upright piston supports 104A and 104B. All these members may be integral or fixedly connected together to form the basic structure of the assembly. Ribs 112A and 112B are shown supporting and strengthening the piston supports. Rotatably mounted openings (not shown) in left plate 102A and right plate 102B rotatably hold a rotating shaft 114 which extends the length of the assembly. A conventional bearing may be used. The rotating shaft 114 is fixedly connected to rotating plate 116 such as by welds, fasteners, and combinations thereof. A weld 136 is shown. The ends of rotating shaft 114 are fixedly connected to left piston hub 108A and right piston hub 108B. The piston hubs are rotably connected to pistons 106A and 106B so that when the pistons are actuated the piston hubs rotate and thereby rotate rotating shaft 114 and fixedly connected rotating plate 116.

Figure 11:
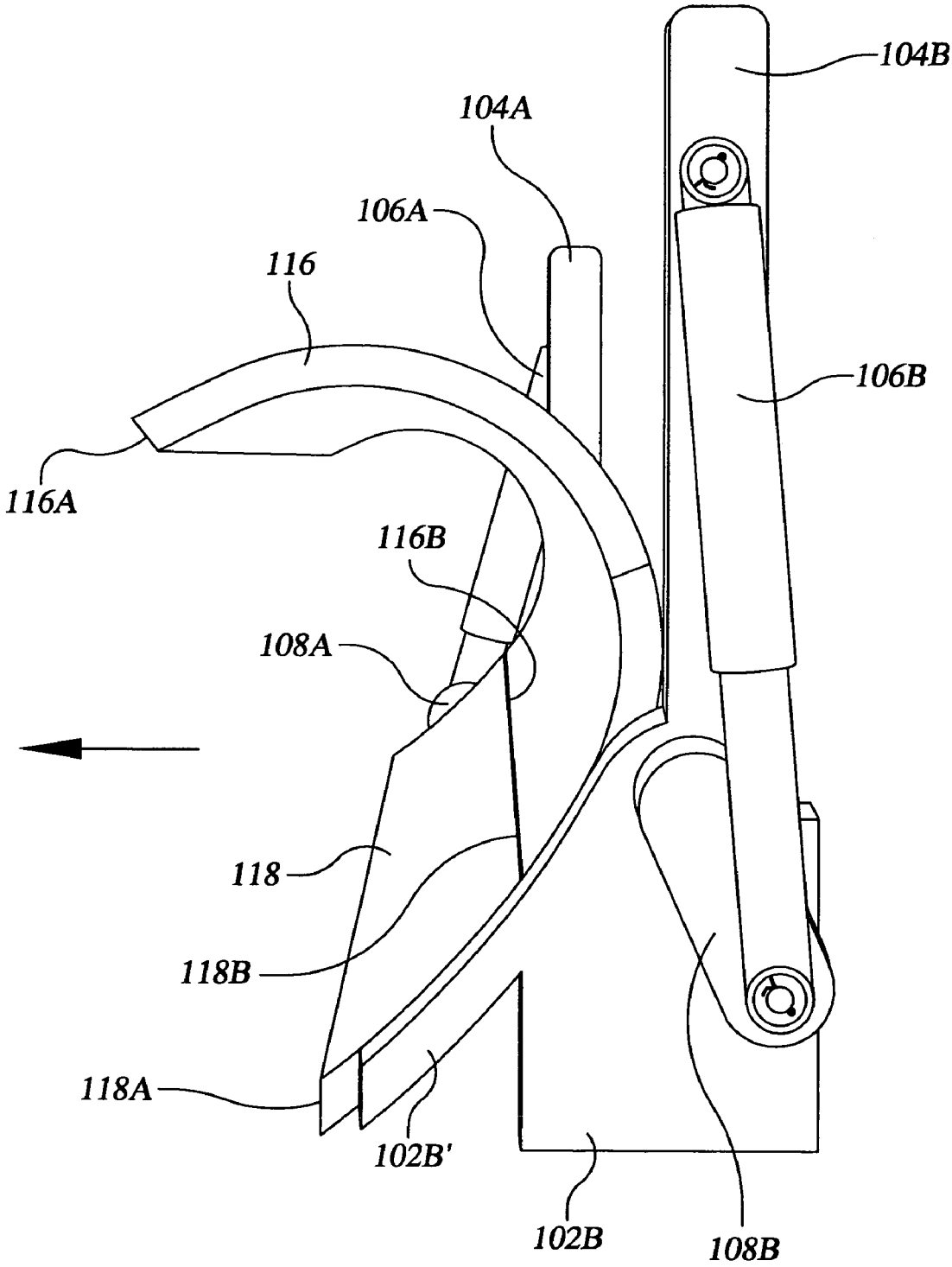
FIG. 11 is a side elevational view of the assembly of FIG. 10 in the plow position.

Referring now to FIG. 11, the claw and plow assembly 100 is shown in a side elevational view. The support plate 102B has a downwardly extending portion 102B' which is fixedly attached to a stationary plow plate 118. The claw and plow assembly in FIG. 11 is in the plow position so that lower end 116B of rotating plate 116 mates with upper end 118B of fixed plate 118 to form a plowing surface when the assembly is moved in the direction of the arrow.

Figure 12:
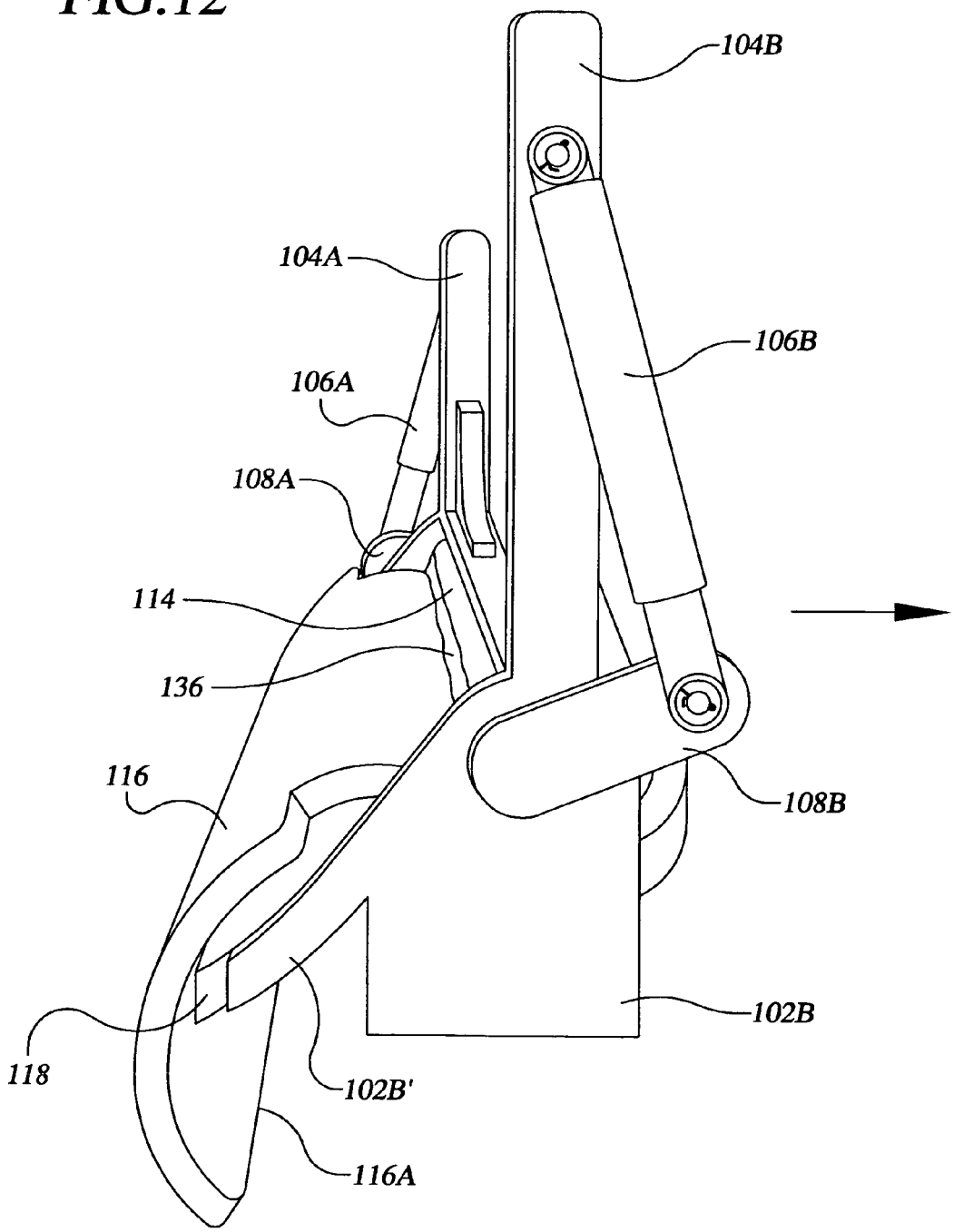
FIG. 12 is a side elevational view of the combination plow and claw assembly of FIG. 10.

FIG. 12 shows the claw and plow assembly of FIG. 11 in the claw position where the rotating plate 116 is rotated downward so that the upper end 116A of the rotating plate 116 is below the plane of the fixed plate 118. When the assembly is moved in the direction of the arrow the assembly acts as a claw whereby the rotating plate 116 will claw the ground or other surface over which the assembly is moved.

The rotating plate 116 of FIGS. 11 and 12 are moved to their respective positions by actuating pistons 106A and 106B which rotates rotating shaft 114 which in turn rotates rotating plate 116.

Figure 13:
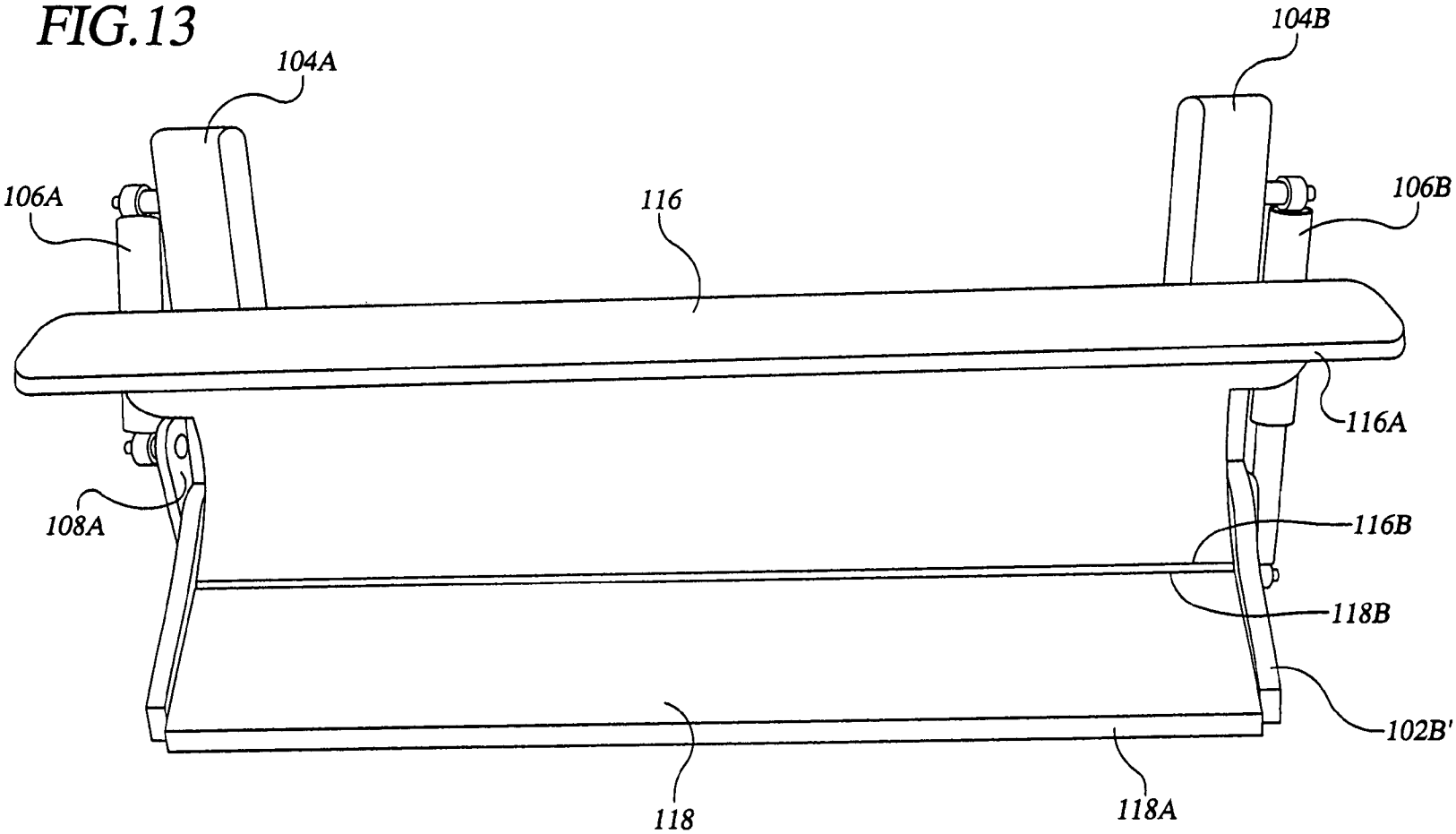
FIG. 13 is a front view of the combination plow and claw assembly of FIG. 10 in the plow position.

FIG. 13 shows a front view of the claw and plow assembly of FIG. 10 in the plowing position. Thus, the rotating plate 116 is rotated to an upward position and the lower end 116B mates with upper end 118B of fixed plate 118 to form a continuous plowing surface.

Figure 14:
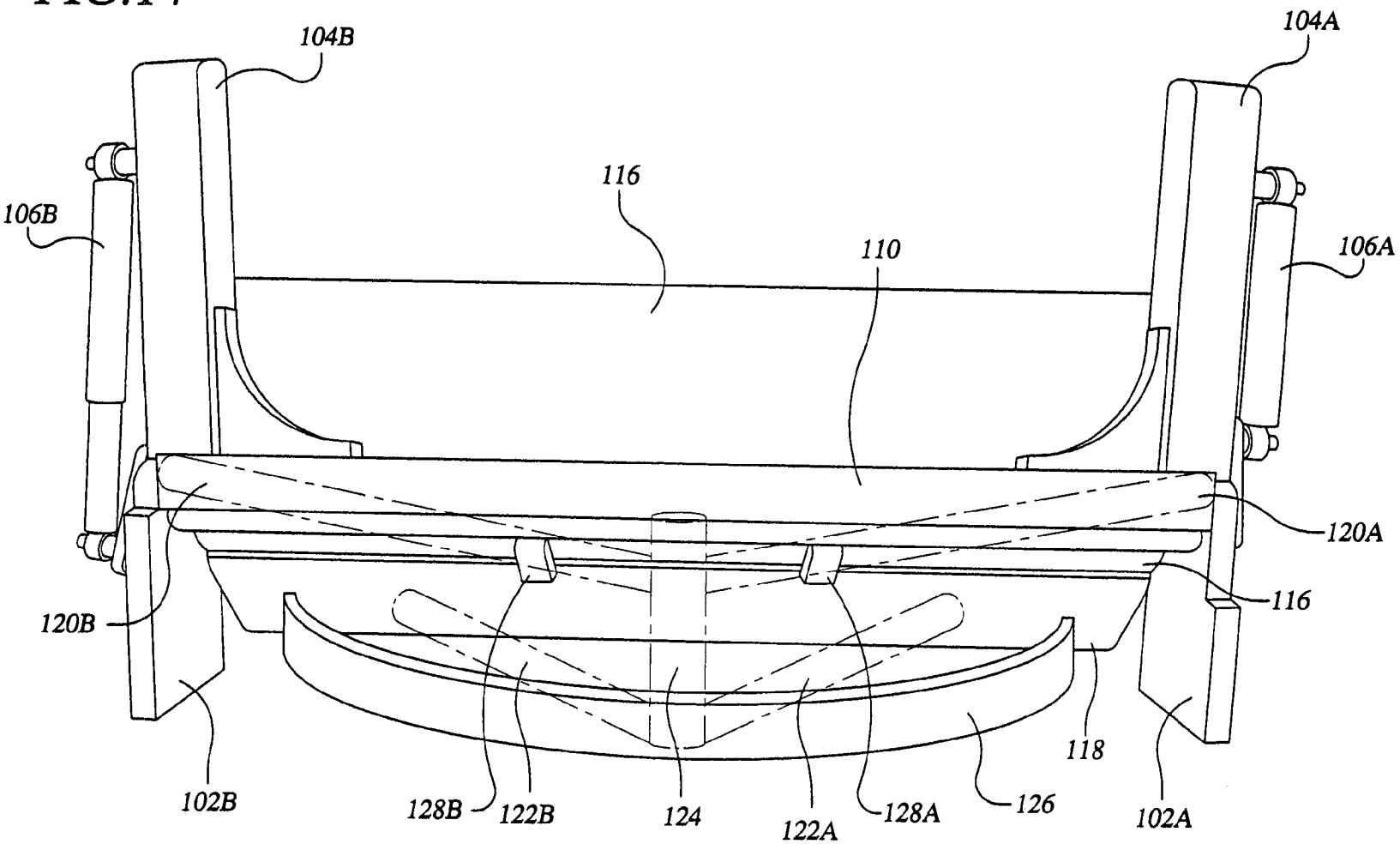
FIG. 14 is a rear view of the combination plow and claw assembly of FIG. 13.

Referring now to FIG. 14, a rear view of the claw and plow assembly is shown. Upper support struts 120A and 120B are fixedly connected to cross member 110 and to vehicle attachment flange 124. Lower support struts 122A and 122B are fixedly connected at one end to fixed plate 118 and at the other end to the lower portion of vehicle attachment flange 124. Another support strut is shown as numeral 126 and is shown fixedly connected at its ends to fixed plate 118. The center of the strut may also be fixedly connected to vehicle attachment flange 124 for added strength. Vehicle attachment flange 124 is used to attach the assembly to a vehicle as is conventional in the art. Other support struts may likewise be used.

Left and right stops 128A and 128B, respectively, are shown attached to rotating plate 116 and their function will be described below.

Figure 15A:
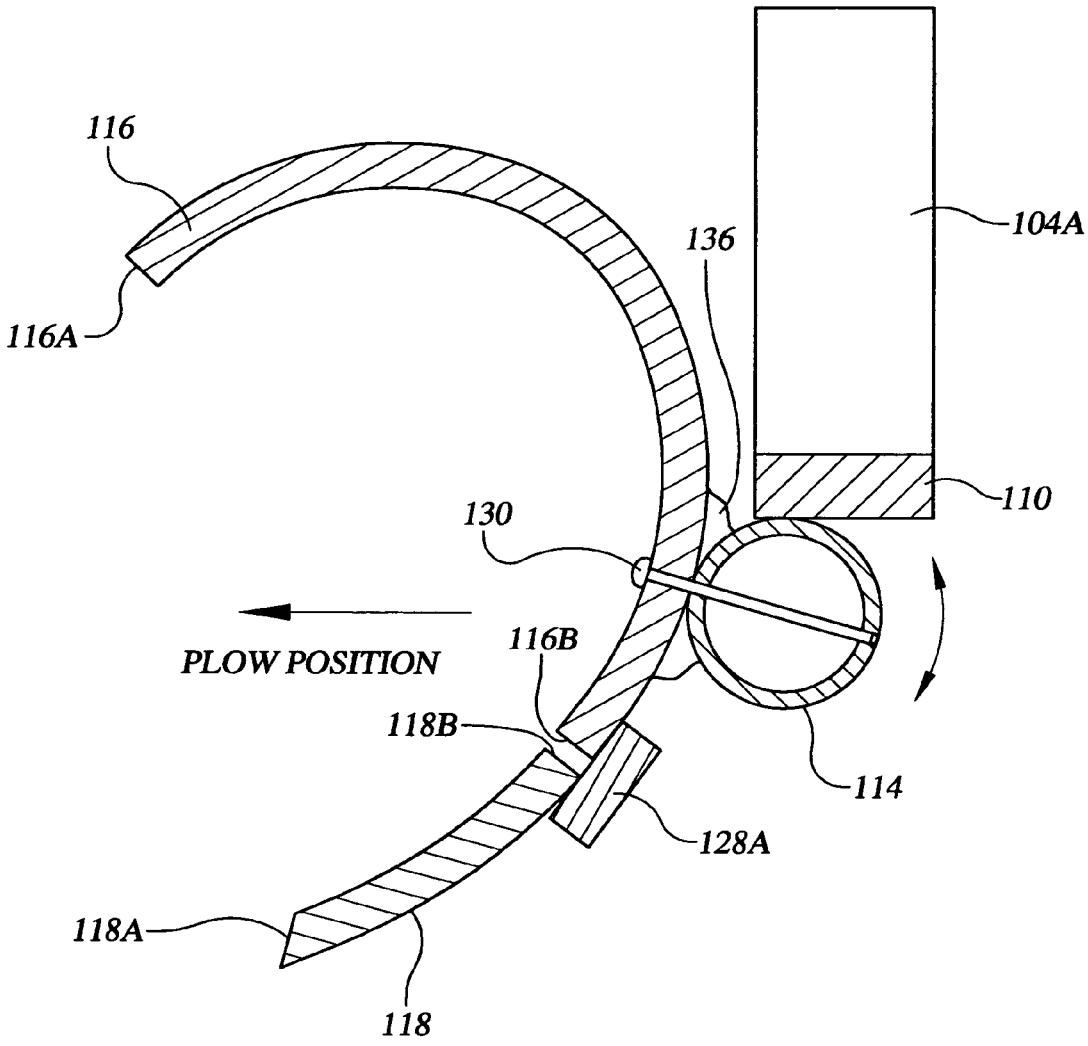
FIG. 15A is a sectional schematic view of the plow and claw assembly shown in FIG. 10 in the plow position as shown in FIG. 11.

Referring now to FIG. 15A, a cross-sectional view of the claw and plow assembly of FIG. 10 is shown. The assembly is shown in the plow position and it can be seen that rotating plate 116 is fixedly secured to rotating shaft 114 by pin 130 and welds 136. One or the other could be used but it is preferred to use both for added strength. It is also preferred that pin 130 extend through rotating shaft 114 for added strength. Welds 136 also provide resistance to rocking at the point of connection between rotating plate 116 and rotating shaft 114. Stop 128A is fixedly connected to the end 116B of the rotating plate 116 and stops rotating plate 116 from rotating past the plane of the fixed plate 118 to form a smooth continuous mated rotating plate 116 and fixed plate 118 surface for plowing.

Figure 15B:
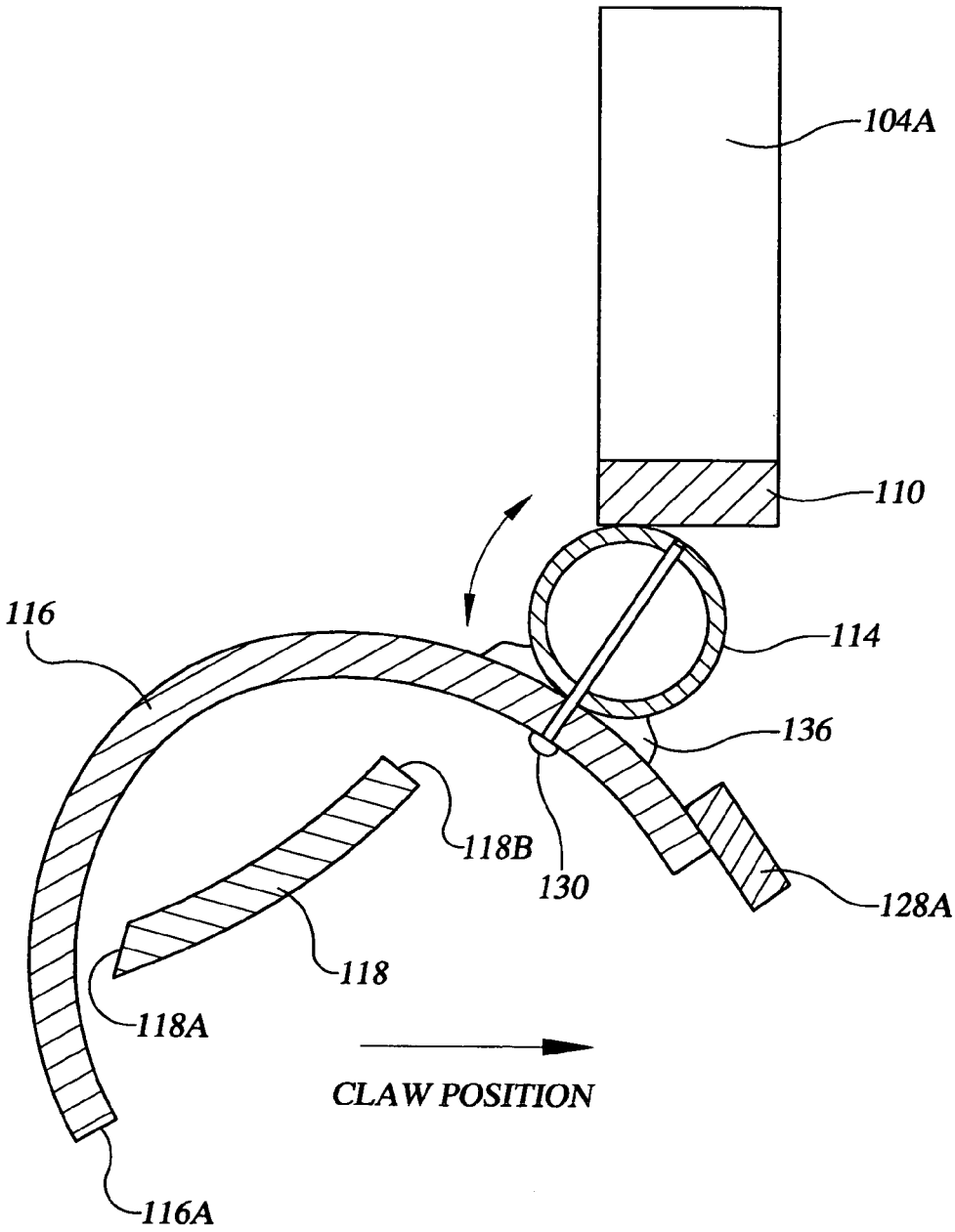
FIG. 15B is a sectional schematic view of the plow and claw assembly shown in FIG. 10 in the claw position.

FIG. 15B shows the plow assembly of FIG. 15A in the claw position whereby rotating plate 116 has been rotated downward by rotating shaft 114 so that the upper end 116A is preferably below the level of lower end 118A of fixed plate 118. When the assembly is moved in the direction of the arrow, the assembly acts as a claw whereby upper end 116A claws the surface over which the assembly is moved.

Figure 16A:
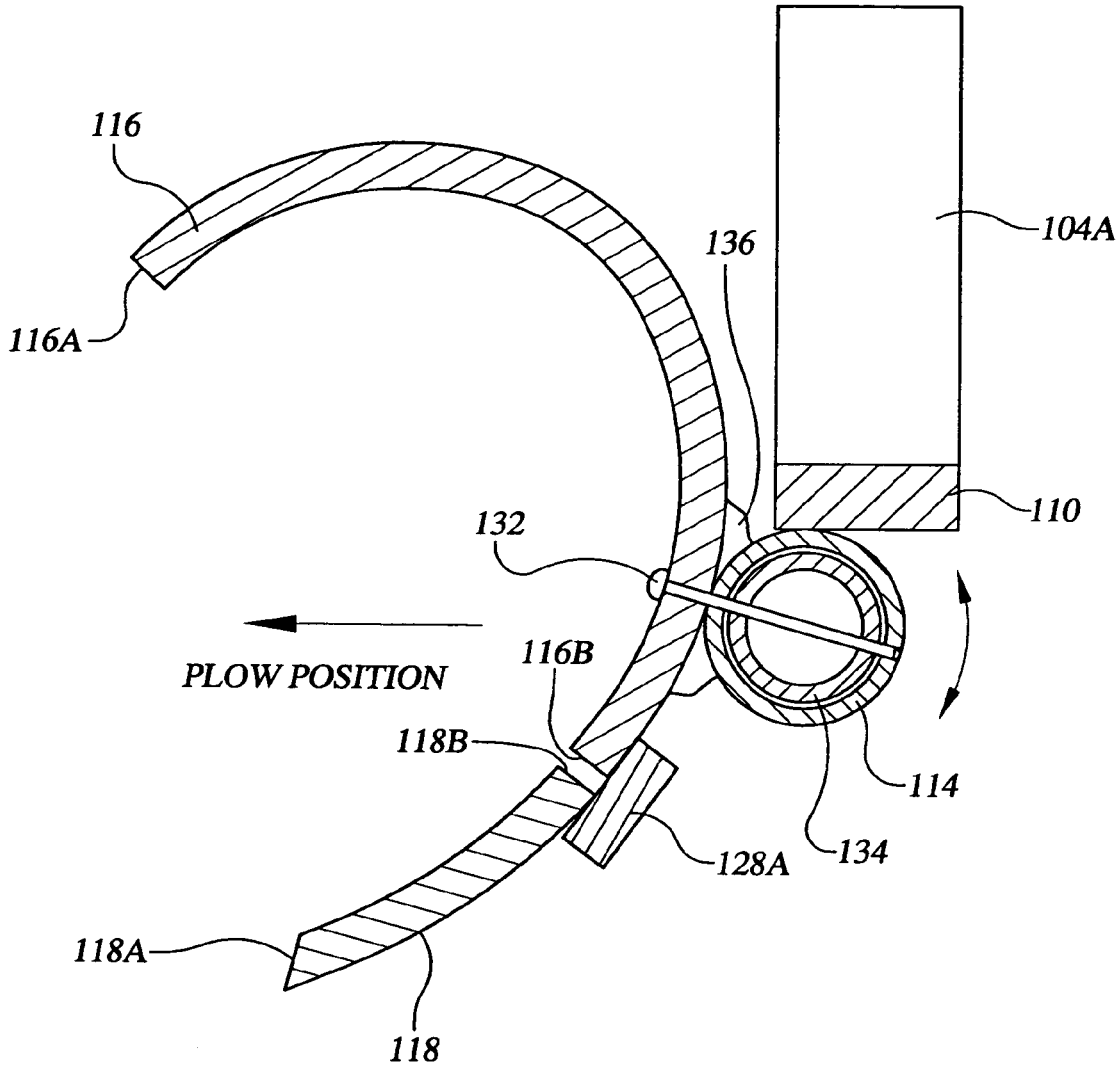
FIG. 16A is a sectional schematic view of another plow and claw assembly of the invention in the plow position.

Referring now to FIG. 16A, a preferred embodiment of the claw and plow assembly of FIG. 15A is shown whereby rotating shaft 114 is still fixedly connected to rotating plate 116. In this assembly an inner rotating shaft 134 extends through openings in the support plates and is fixedly connected to the piston hub so that when the piston hub is moved by the pistons both the inner shaft 134 and rotating shaft 114 are rotated because they are connected together by pin 132. This is a preferred embodiment and is advantageous because if an object is hit that breaks the pin 132 the piston will not be damaged. The assembly of FIG. 16A is shown in the plow position.

Figure 16B:
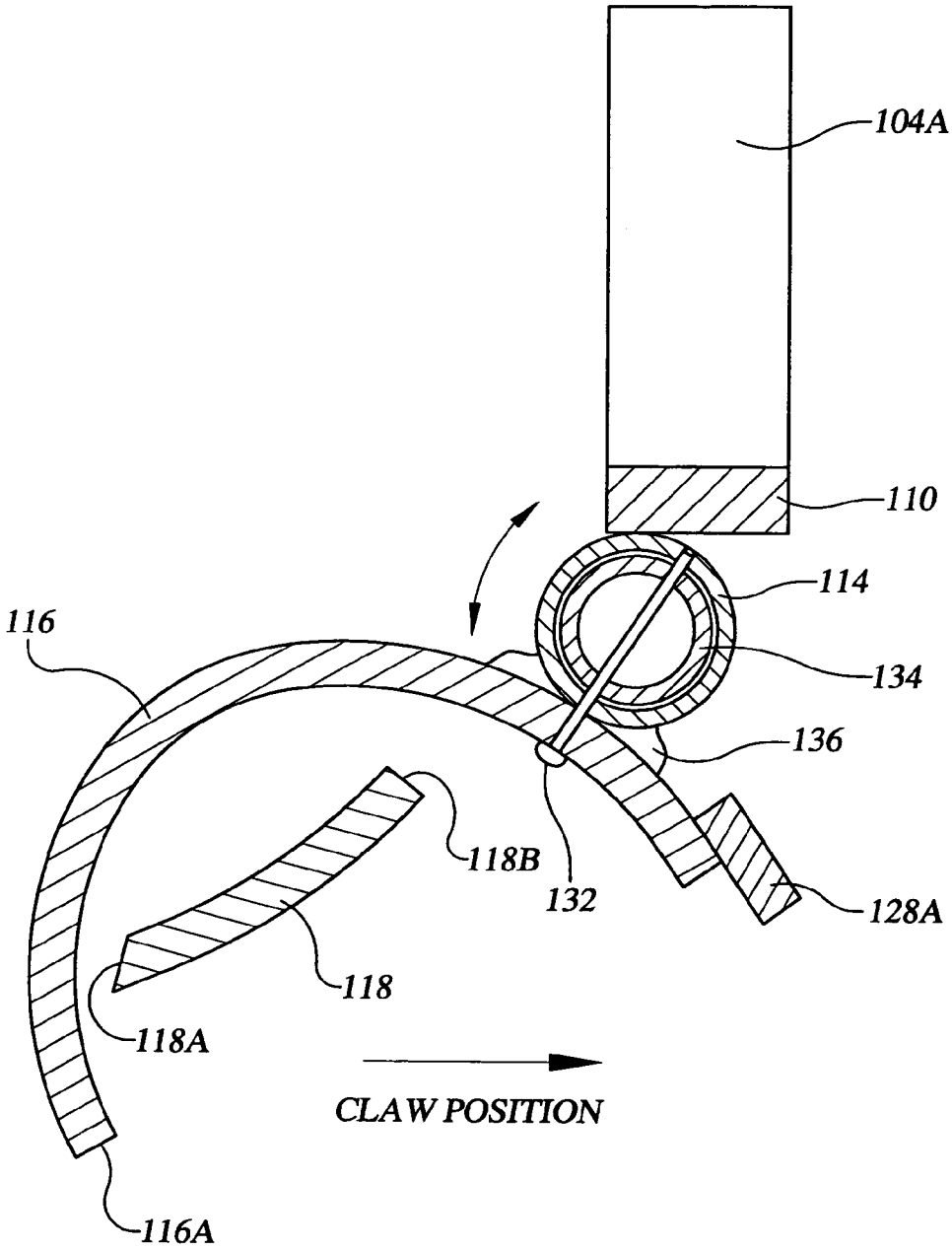
FIG. 16B is a sectional schematic view of the plow and claw assembly shown in FIG. 16A in the claw position.

FIG. 16B shows the assembly of FIG. 16A in the claw position whereby rotating plate 116 is rotated downward so that the upper end of the plate 116A is below the lower end 118A of the fixed plate 118.

The embodiment shown in FIGS. 16A and 16B is also preferable because the rotating plate 116 and connected rotating shaft 114 may be easily removed and changed depending on the job to be performed. Accordingly, the rotating plate 116 and connected rotating shaft 114 are sized to fit between support plates 102A and 102B as shown in FIG. 10. The inner rotating drive shaft 134 extends from the piston hubs 108A and 108B rotatably through support plates 102A and 102B axially into rotating shaft 114. The drive shaft 134 is fixedly connected to the rotating shaft 114 and rotating plate 116 by pin 132 as shown in FIGS. 16A and 16B. Typically multiple pins are used along the length of the rotating shaft 114 for added strength. The inner rotating drive shaft 114 is typically in two (2) portions—with one portion extending from piston hub 108A and the other from piston hub 108B.

If it is desired to change the rotating plate 116, the operator only has to remove the inner drive shaft 134, remove the rotating plate (and attached rotating shaft 114) and replace it with another "rotating plate" and attached rotating shaft 114. For example, it may be desired to use a serrated plate 31 as shown in FIG. 7 or a flexible rake tine 20 as shown in FIG. 5A. Regardless of the "rotating plate" used, the rotating plate 116 is fixed secured to rotating shaft 114 which forms a single piece unit. This unit is then used with the inner drive shaft 134 and the rotating shaft 114 and rotating plate 116 secured thereto to form the desired assembly. A number of units can be made such as a serrated plate unit, a flexible rake tine unit, etc.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A combination plow and claw assembly for plowing a surface and clawing a surface wherein the function of the assembly can be easily changed by the operator of a vehicle during use of the assembly comprising:

opposed fixed support plates connected by an elongated cross member forming a support structure;

an elongated rotating member rotatably mounted in openings in the support plates;

means to rotate the rotating member;

an elongated rotating plate fixedly connected to the rotating member and having a lower end and an upper end;

an elongated stationary plate fixedly connected to the support plates and having an upper end and a lower end; and support means for attachment of the structure to vehicle moving means;

wherein, when the plow and claw assembly is used as a plow with the vehicle moving means moving forward, the elongated rotating plate is rotated to an upward position so that the lower end of the rotating plate and upper end of the stationary plate are proximate and, when the plow and claw assembly is used as a claw with the vehicle moving means moving backwards, the elongated rotating plate is moved to a downward position so that the upper end of the rotating plate is below the lower end of the stationary plate and proximate the surface to be clawed.

2. The combination plow and claw assembly of claim 1 wherein the rotating plate is curved inward at its upper end.

3. The combination plow and claw assembly of claim 2 wherein the means to rotate the rotating member is a piston.

4. The combination plow and claw assembly of claim 1 wherein the elongated rotating plate and the rotating member fixedly connected thereto are sized to fit between the support plates and the assembly further comprises an inner rotating drive shaft axially disposed in the rotating member and fixedly connected thereto with the inner rotating drive shaft connected to the rotating means through openings in the support plates so that the elongated rotating plate and the rotating member rotate when the inner rotating drive shaft is rotated by the rotating means.

5. The combination plow and claw assembly of claim 4 wherein the inner rotating drive shaft is fixedly connected to the rotating member by a pin which will shear if the rotating plate hits an object.

6. The combination plow and claw assembly of claim 5 wherein the pin extends through the rotating plate, rotating member and inner rotating drive shaft.

7. The combination plow and claw assembly of claim 1 wherein the elongated rotating plate is a serrated plate or a flexible tine.

* * * * *